US005518068A

United States Patent [19]

Ricard

[11] Patent Number: 5,518,068

[45] Date of Patent: May 21, 1996

[54] INSTALLATIONS FOR CLEANING TUBES BY CIRCULATING RESILIENT BALLS

[75] Inventor: Roger Ricard, Lamorlaye, France

[73] Assignee: Technos Et Compagnie, Suresnes, France

[21] Appl. No.: 424,618

[22] Filed: Apr. 19, 1995

[30] Foreign Application Priority Data

Apr. 28, 1994 [FR] France ..... 94 05169

[51] Int. Cl.[6] ..... F28G 1/12

[52] U.S. Cl. ..... 165/95; 15/3.51

[58] Field of Search ..... 165/95; 15/3.5, 15/3.51

[56] References Cited

U.S. PATENT DOCUMENTS

| | | | |
|---|---|---|---|
| 4,476,917 | 10/1984 | Otake et al. | 165/1 |
| 4,556,102 | 12/1985 | Bochinski et al. | 165/95 |
| 4,974,662 | 12/1990 | Bizard | 165/95 |
| 5,086,833 | 2/1992 | Ben-Dosa | 165/95 |

FOREIGN PATENT DOCUMENTS

| | | |
|---|---|---|
| 0353154 | 1/1990 | European Pat. Off. . |
| 2541902 | 4/1976 | Germany . |
| 3125546 | 3/1982 | Germany . |

*Primary Examiner*—Allen J. Flanigan
*Attorney, Agent, or Firm*—Larson and Taylor

[57] ABSTRACT

The invention relates to an installation for cleaning tubes in a tube assembly (1) such as a heat exchanger or a condenser, which assembly comprises n sections in parallel where n is an integer greater than 1, the tubes being cleaned by circulating balls in a flow of water inside the tubes. For each of its sections, the installation comprises a branch length of pipework (6) fitted with its own drive pump (8) and extending between an upstream device (7) for recovering balls that is mounted on the outlet from the section under consideration and a downstream device (10) for reinjecting balls that is mounted at the inlet (2) to said section. The installation has a single device (11) for injecting new balls which is connected to all n lengths (6) by a corresponding number of small diameter pipes (12), thereby enabling the n sections to be served in turn by means of said device and also enabling it to be located at a distance from the tubes to be cleaned, in a location that is easy to access.

9 Claims, 2 Drawing Sheets

INSTALLATIONS FOR CLEANING TUBES BY CIRCULATING RESILIENT BALLS

The invention relates to installations enabling the tubes of a heat exchanger or a condenser to be cleaned by circulating balls of a spongy resilient material that are entrained by a flow of water inside the tubes, the diameter of the balls being slightly greater than the inside diameter of the tubes.

The balls in question are subject to wear, and they must be replaced when their diameter has become too small for them to be effective.

Such replacement implies the need firstly to remove worn balls, and secondly to replace them with new balls.

Worn balls can all be removed simultaneously once it is estimated that the percentage of worn balls within the total collection of circulating balls is high enough for it to be appropriate to change the entire charge.

Alternatively, and preferably, as and when balls wear down to their minimum diameter, they are removed from the circuit by means of a sorter, e.g. of the type constituting the subject matter of U.S. Pat. No. 4,974,662 which sorter can be associated with a ball counter that counts the number of balls remaining in circulation, thereby indicating the number of new balls that need to be injected into the circuit in order to make up its charge of balls, which number is the same as the number of worn balls that have been removed from the circuit.

When new balls are injected into the circuit, they are generally also impregnated with water so as to bring their apparent density close to that of water.

Balls can be impregnated by kneading them by hand under water, or preferably by using an impregnator, e.g. of the type constituting the subject matter of French patent application FR-A-93 07547.

The above-described operations give rise to considerable equipment and labor costs.

These costs are increased whenever the bundle of tubes to be cleaned is subdivided into a plurality of sections that operate in parallel, each including its own cleaning system: thus, the steam condensers of turbines in power stations are generally subdivided into a plurality of sections or "lungs" whenever the power of the turbine exceeds 200 MW. As a general rule, the greater the power of the turbine, the larger the number of such sections: for turbines having power exceeding 1,000 MW, there are often six sections.

Under such circumstances, it is common practice to give each section or "lung" its own complete cleaning system comprising, in particular, means for recovering balls from the outlet of the section under consideration, means for entraining the balls in parallel for recycling purposes back to the inlet of said section, and means for renewing charges of said balls.

Because of such multiplication of equipment and in order to reduce hardware and labor costs, proposals have already been made to enable a plurality of sections, or even all of the sections, to share a single and complete system for renewing charges of balls.

The systems for cleaning the various sections are then either connected in parallel with one another or else in series with one another.

When the cleaning systems are connected in parallel, then the balls collected downstream from each section are directed to a recycling pump that is common to the various sections and that drives them to the upstream ends of the sections. The single system for renewing charges of balls is then disposed on the length of ball recycling circuit that is common to the various systems.

When the cleaning systems are connected in series one after another, the balls collected from the downstream end of a given section are driven by the recycling pump of the cleaning system in said section to the upstream end of the adjacent section such that the balls travel successively through all of the various sections. The single system for renewing the charges of balls is then disposed on any one of the recycling lengths.

Each of those solutions suffers from major drawbacks:

if the cleaning systems are connected in parallel with one another, it is difficult to achieve an appropriate distribution of ball flow rates between the various sections, given the inevitable differences that exist between the head losses within said sections, which head losses are associated with the local extent of clogging within each bundle of tubes: it is then observed that balls are likely to concentrate in sections having the cleanest tubes while, on the contrary, balls are rarest in the dirtiest sections in spite of the fact that those are the sections that are most in need of cleaning;

if the cleaning systems are connected in series one after another, then a local breakdown at any point in the entire series circuit, e.g. in one of the recycling pumps, or a temporary loss of water circulation in one of the sections due to a leak from a tube in its bundle, has the effect of stopping cleaning in all of the tubes of the condenser.

The main aim of the invention is to remedy the above drawbacks by proposing an installation for cleaning all of the tubes in a heat exchanger or condenser that is made up of a plurality of sections in parallel, the installation being both highly effective and very cheap, having only some devices in common for all of the sections.

To this end, the invention provides an installation for cleaning tubes in an assembly comprising n sections in parallel, where n is an integer greater than 1, by circulating balls in a flow of water inside said tubes, the installation comprising for each of said sections, a branch length of pipework including an upstream device for recovering balls, which device is mounted on the outlet from the section under consideration, a drive pump, a ball collector, and a device for reinjecting balls, which device is mounted at the inlet of said section, the installation being essentially characterized in that it comprises a single device for injecting new balls that is connected in such a manner as to serve each of the n lengths in turn.

In advantageous embodiments, use is made of one or more of the following dispositions:

the device for injecting new balls comprises a single new ball receptacle connected to the n lengths via n pipes fitted with n respective valves;

the receptacle is connected, via a duct having a valve, to a source of water under pressure;

the receptacle is connected, via a duct fitted with a valve and a pump, to the upstream water duct for the tube assembly to be cleaned;

the receptacle is generally in the form of a body of revolution about an axis, and the duct opens out tangentially into said receptacle;

the receptacle is associated with a device suitable for impregnating the new balls it receives with water;

the cleaning installation further includes a single device for extracting worn balls that is mounted in such a manner as to be connected to each of the n lengths in turn via n pipes fitted with n respective valves;

the n pipes associated with the n valves are common both to the device for extracting worn balls and to the device for injecting new balls, and to this end they are usable alternately in opposite directions for each of those two functions respectively; and the n pipes connecting at least the new ball injection device to the n branch lengths have inside diameters that are very slightly greater than the diameters of the balls.

In addition to the above main dispositions, the invention includes certain other dispositions that are preferably used simultaneously therewith and that are explained in greater detail below.

There follows a description of various preferred embodiments of the invention with reference to the accompanying drawings, and naturally given in a manner that is not limiting.

FIG. 1 of the drawings is a diagram of a ball cleaning installation of the invention.

Figure 1:
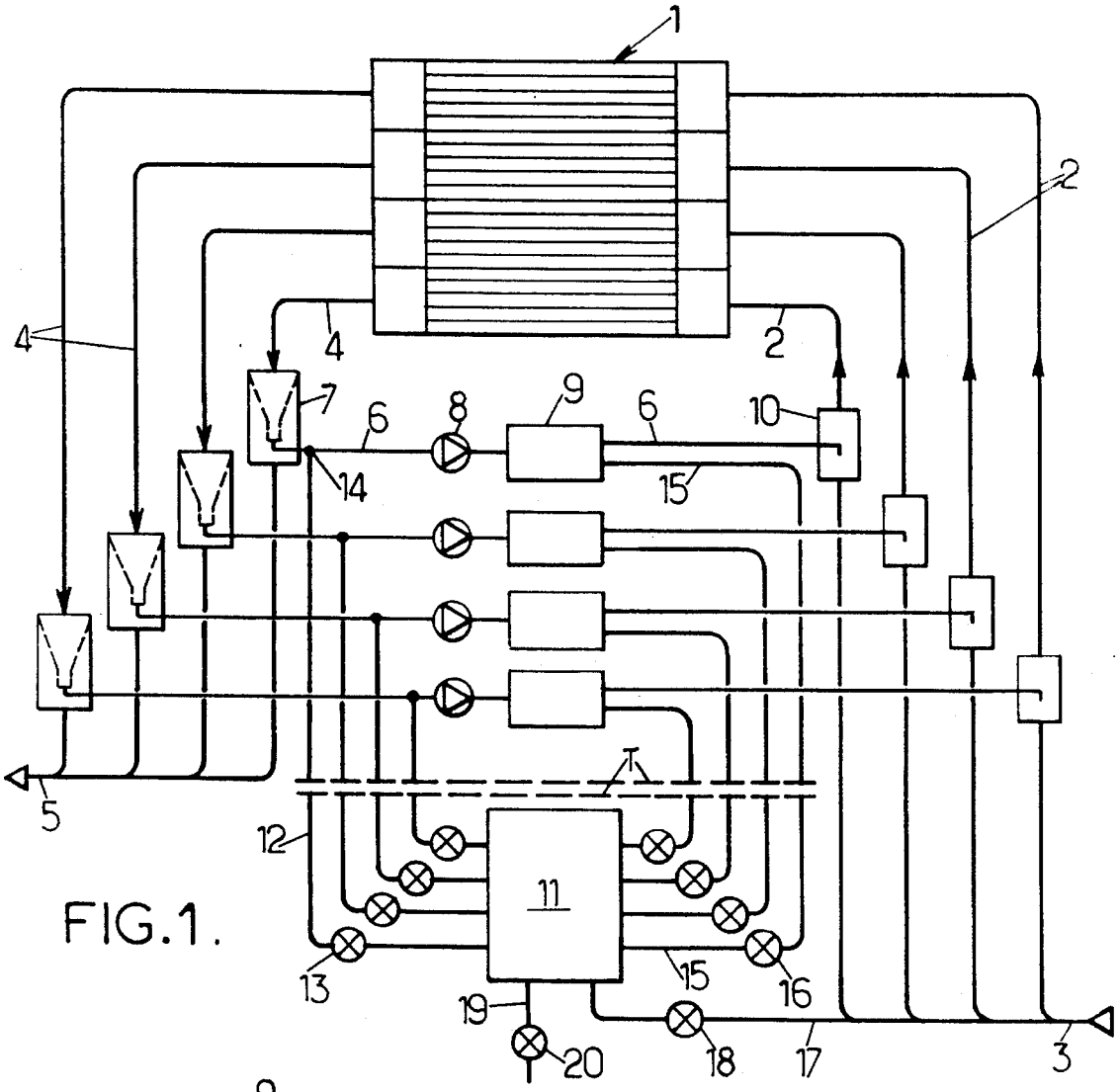

The accompanying drawings relate in general to an installation for cleaning the tubes of a condenser 1 comprising bundles of tubes organized in four identical sections that are connected in parallel.

Each section is served by a cooling water feed pipe 2 itself connected to a common upstream duct 3, and by a heated water outlet pipe 4 connected to a common downstream duct 5.

Each section is also fitted with a ball system for continuous cleaning comprising, in conventional manner, a branch length of pipework 6 itself comprising, in succession:

an upstream grid device 7 suitable for recovering the balls flowing in the outlet pipe 4;

a pump 8 suitable for driving a flow of ball-charged water along the length 6;

a ball collector 9; and a downstream pipe 10 for reinjecting balls into the feed pipe 2.

Each of the various sections of the condenser has its own set of these various devices 6 to 10 that normally operates with a given charge of balls.

The same does not apply to the means provided for renewing charges of cleaning balls, or at least to the means for injecting new balls, and in this case said means are single and common for all four sections, and are therefore designed and connected so as to be capable of serving the four sections successively in turn.

Said single means placed in common comprise essentially a receptacle 11 suitable for being fed with new balls and connected to the four lengths 6 via four pipes each fitted with a respective valve.

In the first embodiment shown diagrammatically in FIG. 1, the pipes and valves in question are designated by references 12 and 13 respectively, and said pipes are connected to the respective lengths 6 at points 14 on those lengths situated immediately upstream from their pumps 8.

In addition, the receptacle 11 of FIG. 1 is connected to the four ball collectors 9 by four pipes 15 fitted with respective valves 16, and to the upstream duct 3 by a duct 17 having a valve 18, and is itself connected to a drain pipe 19 that is fitted with a valve 20.

Figure 2:
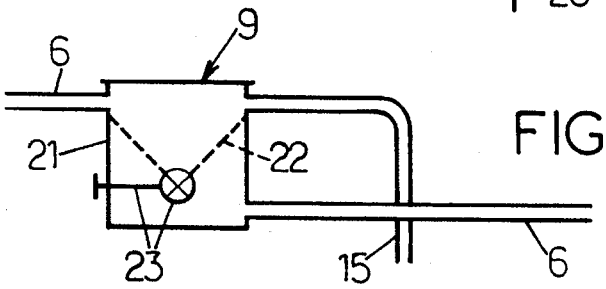
FIGS. 2 and 3 are more detailed diagrams showing one of the devices included in the installation.

In a simple case, each collector 9 may be designed in the manner shown diagrammatically in FIG. 2, i.e. it comprises a housing 21 containing a perforated basket 22 fitted with a ball-trapping valve 23, and the pipe 15 associated with this collector 9 opens out into the housing 21 upstream from the basket 22.

So long as the valve 23 is open and the valve 16 associated with the pipe 15 is closed, then balls circulating in the length 6 pass through the collector 9 without hindrance.

The installation of the type thus shown diagrammatically in FIGS. 1 and 2 operates as follows, with respect to renewing worn balls.

When the cleaning balls in one of the sections of the condenser are worn and it is desired to remove them, the balls of that section are collected in its collector 9 by closing the corresponding valve 23, and then opening the associated valve 16 and the valve 20, while all the other valves 16 and 13 remain closed.

Since the delivery pressure from the pump 8 is always greater than atmospheric pressure, water flows from the collector 9, via pipe 15, to the receptacle 11, and when the receptacle 11 is emptied via the pipe 19, the worn balls as collected in the collector 9 are taken away.

To inject a charge of new balls, the receptacle 11 is filled with water while all of the valves 13 and 16 are closed, then the charge of new balls for injection is inserted into the receptacle 11 via its now disengaged top opening, and the balls of the charge are then impregnated with water by kneading them by hand while they are under water.

Thereafter, the receptacle 11 is closed, the valve 13 of the pipe 12 corresponding to the appropriate condenser section is opened, as is the valve 18 of the duct 17.

The pressure in the duct 17 which is connected to the feed duct 30 is always greater than the pressure in the suction pipework of the pump 8, so water flows from the duct 17 through the receptacle 11 and the pipe 12 into the corresponding length 6, thereby entraining the new balls that are to be injected.

Such a new ball injection operation can be performed in succession for each of the sections of the condenser.

Various improvements can be applied to the simplified assembly as described above.

In particular, instead of impregnating new balls with water by hand, as described above, they may be impregnated by means of a mechanical device.

Such a device may advantageously be one of those described in the above-mentioned French patent application, which device implements at least one pumping cycle of a piston jack or the like.

Figure 3:
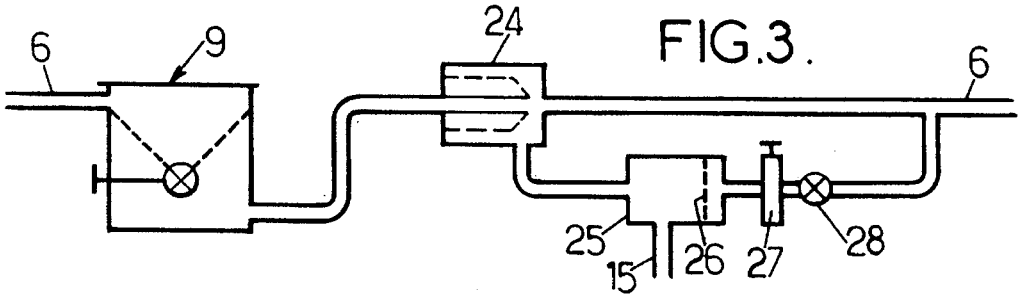

Similarly, each new ball collector may be associated with or replaced by a ball sorter 24 (FIG. 3) itself mounted on the length 6 and combined with a housing 25 that contains a perforated partition 26 suitable for passing water but not balls, the inside portion of said housing situated upstream from the partition 26 being connected to the corresponding pipe 15, while its downstream portion is connected to the length 6 via a diaphragm 27 of adjustable section and a valve 28 (as described in the above-mentioned U.S. patent, for example).

The assembly constituted by the elements 24 and 28 is operated differently from the collector 9 in that the pipe 15 serves to remove only the most heavily worn balls circulating in the length 6, i.e. balls having a diameter that is smaller than a predetermined threshold value: these balls are collected in the housing 25 and the minimum diameter taken into consideration as defining the wear threshold can be adjusted by adjusting the aperture of the diaphragm 27.

Figure 4:
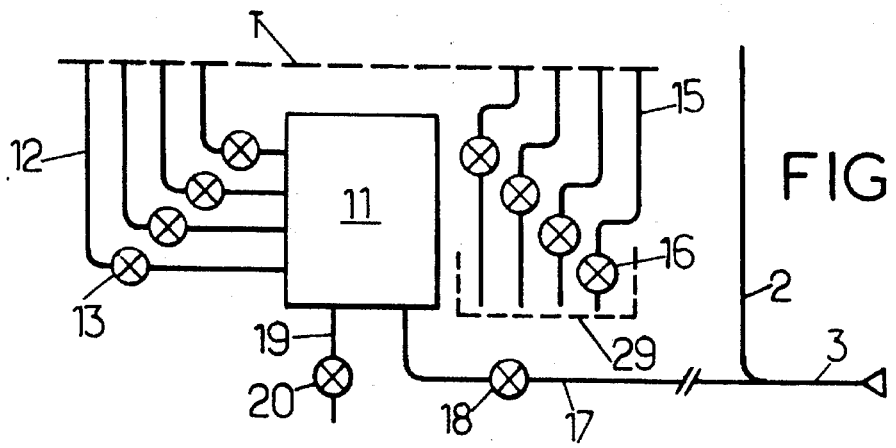
FIGS. 4 and 5 show in a manner similar to FIG. 1, two variants in accordance with the invention of a portion of the cleaning installation.
Figure 5:
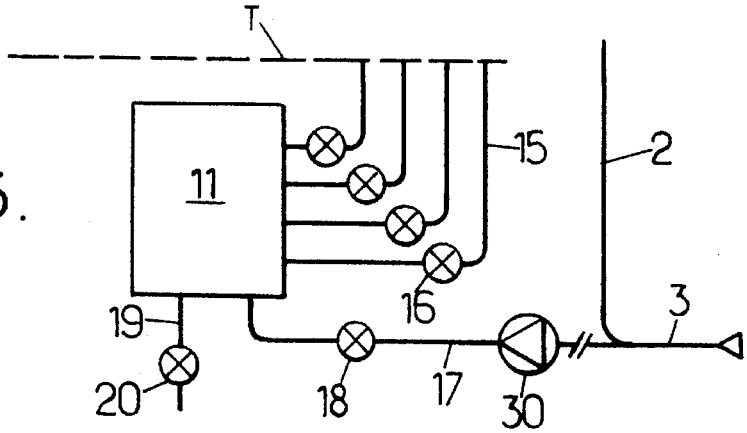

FIGS. 4 and 5 show two possible variants in accordance with the invention of the overall scheme shown in FIG. 1.

FIG. 4 shows only that portion of the installation which is to be found beneath a dashed line T.

This figure shows those elements that have previously been described under the following references 2, 3, 11, 12, 13, 15, 16, 17, 18, 19, and 20.

However, in this case, instead of the downstream ends of the pipes 15 opening out into the receptacle 11, they open out directly into a perforated basket 29 where worn balls can be collected.

In the embodiment of FIG. 5, only those portions of the installation that exist beneath the dashed line T have been shown.

This figure shows those elements of FIG. 1 that have been designated by the references 2, 3, 11, 15, 16, 17, 18, 19, and 20.

This new variant differs from the FIG. 1 embodiment in that the pipes 12 and their valves 13 have been completely omitted (which naturally also assumes that the vertical line portions of FIG. 1 corresponding to the pipes 12 and situated above the dashed line T are also omitted).

In addition, the pipe 17 is fitted with a circulation pump 30 suitable for increasing the circulation force of water coming from the pipe 3 into the pipe 17, going towards the receptacle 11.

In particular, this pump is capable of delivering water at a pressure higher than that to be found in the collectors 9.

Under such circumstances, used balls are removed as before, with the valve 18 being closed and with the pump 30 not operating.

When it comes to injecting new balls that have been impregnated with water, that is done by means of the flow of water driven by the pump 30 after opening the valve 18 and the valve 16 corresponding to the appropriate section, said injection then taking place through the same pipe 15 as was used previously for removing the worn balls.

This variant is particularly advantageous in that it makes it possible to eliminate all of the pipes 12 and their valves 13.

Naturally, instead of being connected to the feeder duct 3 via the pump 30, the duct 17 could be connected directly to any other source of water at a pressure greater than that which prevails in the ball collectors 9: that would apply in particular when pressurized water mains is available in the vicinity of the condenser to be cleaned, which mains could be constituted, for example, by a fire hydrant system installed in the power station associated with said condenser.

For reasons of economy and ease of installation, it is advantageous for the pipes 12 and 15 to be relatively long (their length being represented by the gap that extends between the two parallel dashed lines T interrupting said pipes) and for them to be as small as possible in diameter.

To this end, it is possible for these pipes to be constituted by pipes whose inside diameter is very slightly greater than the diameter of new balls.

Under such circumstances, to facilitate inserting balls into such pipes, it may be advantageous to establish swirling motion in the water circulating inside the collector housings 21 and/or 25 used in such a manner that the balls are presented successively to the immediate vicinity of the inlet to the pipe 15 into which they are to be sucked, which inlet opens radially into the corresponding housing with no more than a small coupling chamfer (not shown) to assist in inserting each ball.

Figure 6:
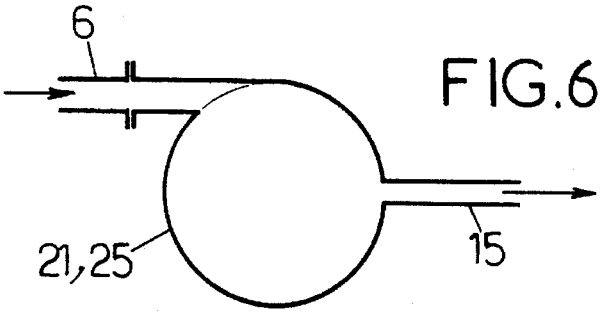
FIGS. 6 and 7 are diagrams showing advantageous embodiments in accordance with the invention of two of the devices included in the cleaning installation.

Such swirling motion can be obtained by admitting water into the housing tangentially, as shown in FIG. 6.

Figure 7:
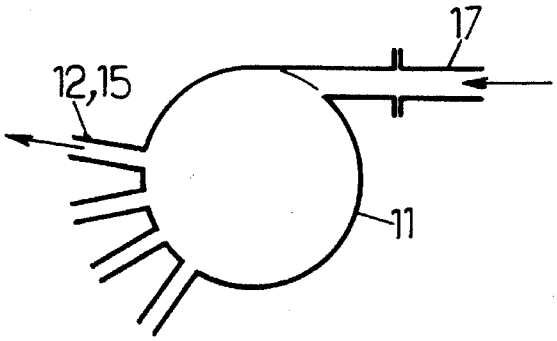

In the same manner, and for the same reasons, it is advantageous for the connection of the duct 17 to the receptacle 11 to take place tangentially thereto, as shown in FIG. 7, thereby facilitating injection of new balls through the relatively small diameter pipes 12 or 15.

As a result, whichever embodiment is used, an installation is obtained for cleaning the tubes of a heat exchanger or condenser that is subdivided into a plurality of parallel sections, having a structure and operating in a manner that can be seen sufficiently clearly from the above description.

The installation presents numerous advantages over previously known installations.

In particular, it is particularly economical in that all of the means used for injecting new balls and, where appropriate for removing worn balls, are common to all of the sections instead of being multiplied by a factor equal to the number of such sections.

This advantage is particularly appreciable when the new ball injection device is associated with a water impregnator that is automatic to a greater or lesser extent.

Another major advantage of having the new ball injection device in common lies in the requirement for a single supply of new balls for the entire installation, thereby simplifying problems of supply while simultaneously improving safety.

In other words, the invention makes it possible to use in common the only station in the entire cleaning installation that requires external intervention on a long-term basis, i.e. the reserve of new balls: with the invention it is necessary to monitor a single supply of new balls rather than monitoring as many supplies as there are "sections".

In spite of these manifest advantages, the installation does not suffer from any of the drawbacks mentioned above that apply to parallel- or series-connected organizations of the various sections: the cleaning circuits of the various sections remain individualized and independent while they are in operation, there is no risk of balls being unequally shared between the various sections; likewise, if something should go wrong in any one of the sections, that will not automatically stop cleaning in the other sections.

It is also important to observe that the receptacle 11 can easily be installed at a distance from the bundle of tubes to be cleaned, in a location that is easier of access for operating personnel than is said bundle of tubes, with this being the case because the receptacle can be connected to the branch lengths 6 by means of pipes (12, 15) that are long (they may easily be about 100 meters long, or even longer), which pipes have a relatively small inside diameter that is hardly any greater than the diameter of the balls; whereas in presently-existing installations, the pipes connecting new ball injection devices to the installations in question have a diameter of about 80 mm, in the present case the corresponding diameter is advantageously no more than about 1.1 to 1.5 times the diameter of the balls, which diameter generally lies in the range 18 mm to 40 mm; in particular, for balls having a diameter of about 19 mm, the outside diameter of the pipes in question can be equal to only 25.4 mm (i.e. 1 inch) for a wall thickness of about 2 mm.

Naturally, and as can already been seen from the above, the invention is not limited in any way to the particular applications and embodiments described in detail; on the contrary, the invention extends to any variants thereof.

I claim:

1. An installation for cleaning tubes in an assembly (1), such as a heat exchanger or condenser, comprising n sections in parallel, where n is an integer greater than 1, by circulating balls in a flow of water inside said tubes, the installation comprising for each of said sections, a branch length of pipework (6) including an upstream device (7) for recovering balls, which device is mounted on the outlet (4) from the section under consideration, a drive pump (8), a ball collector (9), and a device (10) for reinjecting balls, which device is mounted at the inlet (2) of said section, the installation being characterized in that it comprises a single device (11) for injecting new balls that is connected in such a manner as to serve each of the n lengths (6) in turn.

2. A cleaning installation according to claim 1, characterized in that the device for injecting new balls comprises a single new ball receptacle (11) connected to the n lengths (6) via n pipes (12; 15) fitted with n respective valves (13; 16).

3. A cleaning installation according to claim 2, characterized in that the receptacle (11) is connected, via a duct (17) having a valve (18), to a source of water under pressure.

4. A cleaning installation according to claim 2, characterized in that the receptacle (11) is connected, via a duct (17) fitted with a valve (18) and a pump (30), to the upstream water duct (3) for the tube assembly (1) to be cleaned.

5. A cleaning installation according to claim 3, characterized in that the receptacle (11) is generally in the form of a body of revolution about an axis, and in that the duct (17) opens out tangentially into said receptacle.

6. A cleaning installation according to claim 2, characterized in that the receptacle (11) is associated with a device suitable for impregnating the new balls it receives with water.

7. A cleaning installation according to claim 1, characterized in that it further includes a single device (11, 29) for extracting worn balls that is mounted in such a manner as to be connected to each of the n lengths in turn via n pipes (15) fitted with n respective valves (16).

8. A cleaning installation according to claim 7, characterized in that the n pipes (15) associated with the n valves (16) are common both to the device for extracting worn balls and to the device for injecting new balls, and to this end are usable alternately in opposite directions for each of those two functions respectively.

9. A cleaning installation according to claim 2 characterized in that the n pipes (12, 15) connecting at least the new ball injection device to the n branch lengths (6) have inside diameters that are very slightly greater than the diameters of the balls.

* * * * *